US011325160B2

(12) United States Patent
Peltonen et al.

(10) Patent No.: US 11,325,160 B2
(45) Date of Patent: May 10, 2022

(54) SEPARATION DEVICE

(71) Applicant: ANDRITZ OY, Helsinki (FI)

(72) Inventors: Kari Peltonen, Kotka (FI); Janne Vehmaa, Kotka (FI); Vesa Kaipainen, Kotka (FI); Sami Siik, Kotka (FI); Sampsa Porkka, Kotka (FI)

(73) Assignee: Andritz Oy, Helsinki (FI)

( * ) Notice: Subject to any disclaimer, the term of this patent is extended or adjusted under 35 U.S.C. 154(b) by 87 days.

(21) Appl. No.: 16/641,402

(22) PCT Filed: Aug. 31, 2018

(86) PCT No.: PCT/FI2018/050616

§ 371 (c)(1),
(2) Date: Feb. 24, 2020

(87) PCT Pub. No.: WO2019/043296

PCT Pub. Date: Mar. 7, 2019

(65) Prior Publication Data

US 2020/0222942 A1 Jul. 16, 2020

(30) Foreign Application Priority Data

Aug. 31, 2017 (FI) ..... 20175776

(51) Int. Cl.
*B07B 13/00* (2006.01)
*D21D 5/06* (2006.01)

(52) U.S. Cl.
CPC ..... *B07B 13/003* (2013.01); *D21D 5/06* (2013.01); *B07B 2230/01* (2013.01)

(58) Field of Classification Search
CPC ... B07B 13/003; B07B 2230/01; B01D 29/00; B01D 29/64; B02C 7/02; B02C 7/00;
(Continued)

(56) References Cited

U.S. PATENT DOCUMENTS 1,185,794 A * 6/1916 Haug ..... D21D 5/06 209/270
3,774,761 A 11/1973 Wikdahl
(Continued)

FOREIGN PATENT DOCUMENTS

CN 86101566 A 11/1986
CN 2158885 Y 3/1994
(Continued)

OTHER PUBLICATIONS

International Search Report for PCT/FI2018/050616, dated Nov. 15, 2018, 5 pages.
(Continued)

*Primary Examiner* — Gene O Crawford
*Assistant Examiner* — Muhammad Awais
(74) *Attorney, Agent, or Firm* — Nixon & Vanderhye P.C.

(57) ABSTRACT

A separation device having a housing (10) with a feed conduit (1) and a reject conduit (2), between which conduits (1, 2) and an accept conduit (3) of the housing (10) is a rotor unit (13) having a shaft (4) transverse to the through-flow direction of the separation device, which shaft rotates discs (5) attached to the shaft (4), the outer surface and/or side surfaces of which discs are jagged, i.e. they have protrusions (6) and/or notches and/or these surfaces are substantially rough and the teeth (9) of at least two sieves (7, 8) attached to the housing (10), extend between the discs (5), the first sieve (7) being between the reject conduit (2) and the accept conduit (3) and the second sieve (8) being between the feed conduit (1) and the accept conduit (3).

22 Claims, 5 Drawing Sheets

Figure 1:
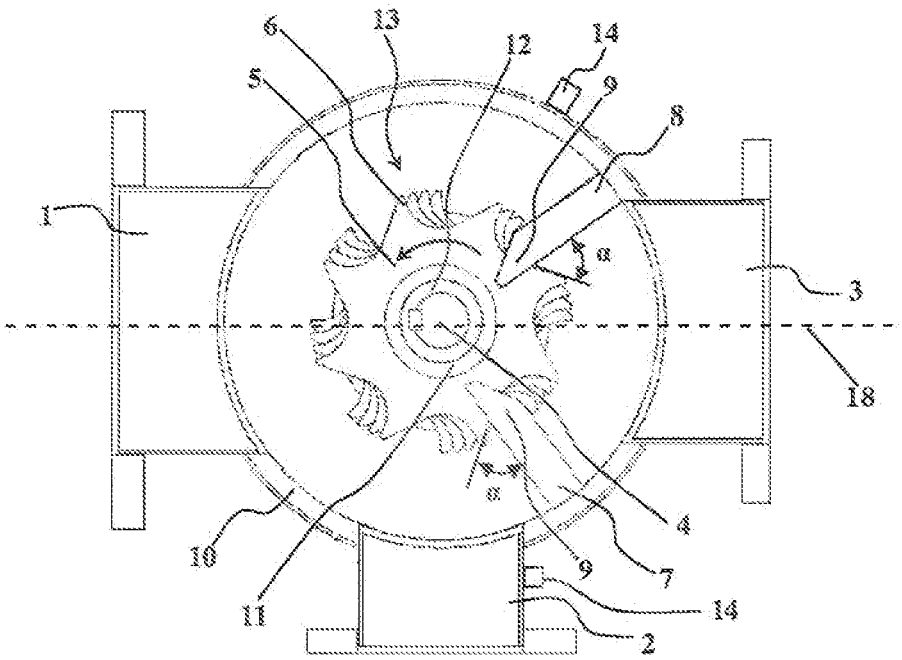

(58) Field of Classification Search
CPC . D21B 1/026; D21D 5/00; D21D 5/02; D21D 5/04; D21D 5/06; D21D 5/20
USPC ..... 209/271; 210/413, 415; 241/261.2
See application file for complete search history.

(56) References Cited

U.S. PATENT DOCUMENTS

| | | | | | |
|---|---|---|---|---|---|
| 4,303,207 | A | | 12/1981 | Lindström | |
| 4,529,509 | A | * | 7/1985 | Nilsson | B01D 33/466 209/270 |
| 4,729,837 | A | | 3/1988 | Henricson | |
| 4,737,274 | A | | 4/1988 | Jacobsen et al. | |
| 4,911,828 | A | | 3/1990 | Musselmann et al. | |
| 4,991,720 | A | | 2/1991 | Hoglund et al. | |
| 5,192,438 | A | * | 3/1993 | Frejborg | D21D 5/026 209/273 |
| 5,566,833 | A | * | 10/1996 | Pfeffer | B01D 29/118 209/273 |
| 5,967,335 | A | * | 10/1999 | Clarstrom | B07B 1/18 209/389 |
| 6,332,545 | B1 | * | 12/2001 | Izumi | B01D 33/073 210/396 |
| 2009/0218259 | A1 | * | 9/2009 | Mori | B07B 4/025 209/559 |

FOREIGN PATENT DOCUMENTS

| | | | | |
|---|---|---|---|---|
| CN | 1494626 | A | 5/2004 | |
| CN | 1542220 | A | 11/2004 | |
| EP | 0 198 787 | | 10/1986 | |
| EP | 0 515 530 | | 10/1994 | |
| EP | 2816153 | A1 * | 12/2014 | D21D 5/026 |
| FI | 71671 | | 10/1986 | |
| FI | 118739 | | 2/2008 | |
| WO | 96/19614 | | 6/1996 | |

OTHER PUBLICATIONS

Written Opinion of the ISA for PCT/FI2018/050616, dated Nov. 15, 2018, 6 pages.

* cited by examiner

SEPARATION DEVICE

This application is the U.S. national phase of International Application PCT/FI2018/050616 filed Aug. 31, 2018, which designated the U.S. and claims priority to Finnish Patent Application 20175776 filed Aug. 31, 2017, the entire contents of both applications is incorporated by reference.

The invention relates to a separation device for separating oversize pieces from liquid and solids containing suspension, such as cellulose suspension.

BACKGROUND OF THE INVENTION

The equipment and processes of the cellulose and paper industry usually endure some amount of different impurities, such as sand, but the feed material may contain larger pieces such as stones, bolts etc. metal pieces. Fibrous pieces can often be utilized and defibrated in later process stages, as long as they do not hamper the operation of the equipment. The aim is to keep the feed pulp at a high concentration, due to which it contains pieces, which at a lower concentration would remain on the bottom of the basins and containers. Usually a largest particle size is determined for process equipment, which the equipment endures without being damaged or without compromising quality. The purpose of the separation device is to separate these coarser pieces from the stream or to break them. The separation device can be used also for separating slurries or other liquids and solids.

An example of a prior art solution is disclosed in U.S. Pat. No. 4,737,274, where the separation device comprises a chamber, in which the shaft of the separation unit has a toothed rotor that pushes aside towards a reject outlet pieces, which do not pass through a sieve opening. In corresponding solutions the sieve may also be e.g. a perforated plate. Typically in these solutions the rotational speed is so high that it fluidizes pulp, and thus they have a high energy consumption.

SUMMARY OF THE INVENTION

The new separation device has a considerably low power demand and flow resistance and structures that are prone to wearing and breaking are avoided. The separation device is also characterized in accepting three-dimensional pieces of a certain kind and degrading of pieces for being acceptable. Differing from conventional solutions, the rotor unit of the separation device has a shaft transverse with respect to the through-flow direction of the separation device, which shaft rotates discs attached to the shaft, which discs are solid or open in their center and have on their outer surface and/or side surfaces notches or protrusions that make said surface jagged. A jagged surface is also understood as a substantially coarse surface, such as knurling, corrugation or roughening, which is especially advantageous on the side surfaces of the discs. The teeth of at least two sieves attached to the housing extend between the discs, the first of which sieves is between the reject conduit and the accept conduit and the second sieve is between the feed conduit and the accept conduit.

Advantageously, the lateral distance between the side surfaces of the disc and the teeth of the first sieve, the point of the teeth of the first sieve and the support members of the discs of the shaft or distance between the support sleeves between the discs and the distance between the base of the sieve and the points of the protrusions of the discs or the substantially round outer surface, i.e. the widths of the separating slots are substantially equal. Thus, the widths of these separating slots should be within 20%. For different sieves these separating slots can vary from each other. These widths of the slots dictate the size of pieces that are separated off from the pulp flow. It is to be noted that often the size of an accepted piece is limited not by its largest but its smallest dimension. Thus, e.g. a thin twig of a limited length or a flat slat can intendedly get through the separation unit. For instance pressurized pulp washers accept such pieces and they disintegrate into fibers or will be removed in later stages. Prior art devices are not good for this kind of separation.

On the outer surface and/or the sides of the discs the jagged surface formed by notches and/or protrusions transfers, tears, crushes and/or grinds oversize pieces against the sieves. Then the pieces clogged between the sieve and the disc are worn or split into acceptable size, whereby they do not cause blockages. The edges of the notches can grip and influence the pieces the same way as protrusions and lumps. If the side surfaces are smooth, pieces that have stuck between them and the sieve can move to the outer circumference, whereby the jagged outer surface of the disc transfers, tears, crushes and/or grinds the pieces and blockages do not occur. The sides of the disc can be conical, whereby they do not necessarily have a cylindrical jagged outer surface and then only the side surfaces are jagged. Then the teeth of the sieves also taper correspondingly towards the apex, in order to keep widths of the separating slots substantially equal.

The first sieve performs major part of the separation, if its flow direction is the same as the more advantageous direction of rotation of the shaft. The disc also does most of the transferring, tearing, crushing and/or grinding of oversize pieces against the first sieve. The additional function of the second sieve is to prevent return flow of accepted pieces. Most advantageously the first sieve is below the discs and the second sieve above the discs for ensuring gravity separation. The speed of rotation of the disc, the flow resistance of the outer and side surfaces of the disc and pressure difference determine the flow volume through the second sieve against the more advantageous direction of rotation of the shaft. Even a partial clogging caused by rejectable pieces in the first sieve leads also to increased flow above the shaft through the second sieve. For optimizing the separation, at least one sieve can be dimensioned differently from the other sieves. For instance the widths of the separating slots of the first sieve, or, to put it differently, the distances between the teeth of the sieve and the discs can be of different size than those of the second sieve.

Advantageously the angle between the outer surface of the disc or the front edges of the protrusions of the disc and the front surfaces of the sieves is positive and most preferably over 10 degrees, whereby the protrusion pushes to its outer circumference and towards the reject conduit a piece stopped by the sieve. A gently rising front surface, where the angle between the sieve is large, also decreases the tendency of the discs to cause swirling and fluidizing flow around them. Flow resistance and thus energy consumption can be further decreased by shaping the front surface of at least some protrusions convex and/or back surface tapered.

Advantageously at least some of the teeth of the sieves are at their apex in the thickness direction chamfered thinner than at their base, whereby the flow resistance through the sieve is minimized, but the construction remains solid. Especially the front surface of the first sieve can be convex. The front surface of the sieve means the surface facing the direction of rotation of the discs. Still more advantageously the trailing edge of the first sieve is tapered, i.e. the shaping of the teeth of the sieve can correspond to the shaping of the protrusion of the disc that was mentioned earlier. The front surfaces and trailing edges of the second sieve are advantageously shaped in an opposite way, because the flow direction of the pulp is to the other direction. Decreasing the flow resistances balances the flows between the first and the second sieve. Also the risk of accumulation of blockage by fibers and passed through pieces behind the second sieve is decreased. Then the sieve can be located closer to the feed conduit. When the outer surface of the disc is substantially round, i.e. without protrusions or with low protrusions, the angle between the front surface of the sieve and the outer surface of the disc is advantageously over 80 degrees. Then oversize pieces are guided outwardly and do not get stuck between the disc and the sieve.

Advantageously the second sieve is beside the accept conduit in the direction of rotation of the shaft downstream of the accept conduit. Then rotation of discs does not cause substantial backflow, but the sieve guides pulp into the accept conduit. On the other hand, it may be advantageous to locate the second sieve beside the feed conduit, whereby especially heavy metallic reject pieces fall more efficiently down towards the reject conduit and fiber-containing lighter materials more efficiently move along into the first sieve to be degraded and no material is accumulated to the feed side of the second sieve. Sieves can be arranged between the feed conduit and the accept conduit at both said locations, whereby all advantages resulted from the locations are achieved.

Advantageously the discs are attached to the rotary shaft and/or to each other by support members parallel to the shaft, whereby the shaft does not occupy the whole space in the center of the rotor unit. The shaft can extend substantially thinner than the center hole of the discs through all of the discs. The shaft can also be divided so that separate shafts at the ends can extend e.g. only to the center of the outermost disc. Then the flow through the separation device can be of greater volume, since the flow can pass between the support members through the open space in the center. The discs can also have a central opening, whereby the flow can pass also through the center of the discs. If a clogging appears inside the support members, closed discs prevent the clogging from spreading in the lateral direction between adjacent discs. Especially the outermost discs are preferably closed except for a shaft opening, whereby the forces are most efficiently conveyed to the shaft rotating or supporting the discs. The width of the slots between the support members and the distance between the discs determine the size of particles that can pass through the hollow central space. The support members can cause chopping of long pieces having passed through them into shorter pieces against the teeth of the sieve, the housing of the device and the openings of the conduits.

Advantageously at least one sieve, most preferably the first sieve, is attached by means of a motion member, such as a slide or a hinge. Then on a blockage occasion the sieve can be moved out of the way directed by an operator or the process controller and the blockage can be released. Then a duct bypassing the separation device can be in operation and the blockage can be guided from the accept channel into the reject channel e.g. by feeding liquid into the accept channel. The blockage can also be guided into another reject channel that is connected to the accept channel downstream of the separation device. If the connection of the sieve yields or it is drawn in by means of a slide due to excess force caused by a reject piece, breaking of the separation device can be avoided. An excess force can activate moving of the sieve e.g. by means of a spring-loaded hinge or forces measured by sensors.

If the outer or side surfaces of the discs are in addition to or instead of protrusions provided with smaller humps or notches, they can tear, crush and/or grind pieces that are close to being accepted. If there are differences between the distances of the humps or notches from the center of the shaft, said effects take place more widely along the length of the separating slots.

If at least some of the biggest protrusions of the discs are located on the shaft in the rotational direction at different locations, the force impacts caused by crashing and hitting of pieces are divided more evenly, which allows avoiding e.g. unnecessary yielding or breaking of the sieves.

Advantageously at least one sensor based on e.g. magnetism. ultrasound, acoustic emission and/or pressure measurements is attached to the reject conduit, to the rotary feeder attached to the separation device, to the housing most preferably in the vicinity of the sieves for detecting generation of blockages and/or the filling of the reject conduit or the device removing reject. Reject material enters the separation device usually only temporarily, so that by means of using sensors the emptying of reject channels can be performed only when needed and not e.g. at regular intervals.

LIST OF DRAWINGS

Figure 2:
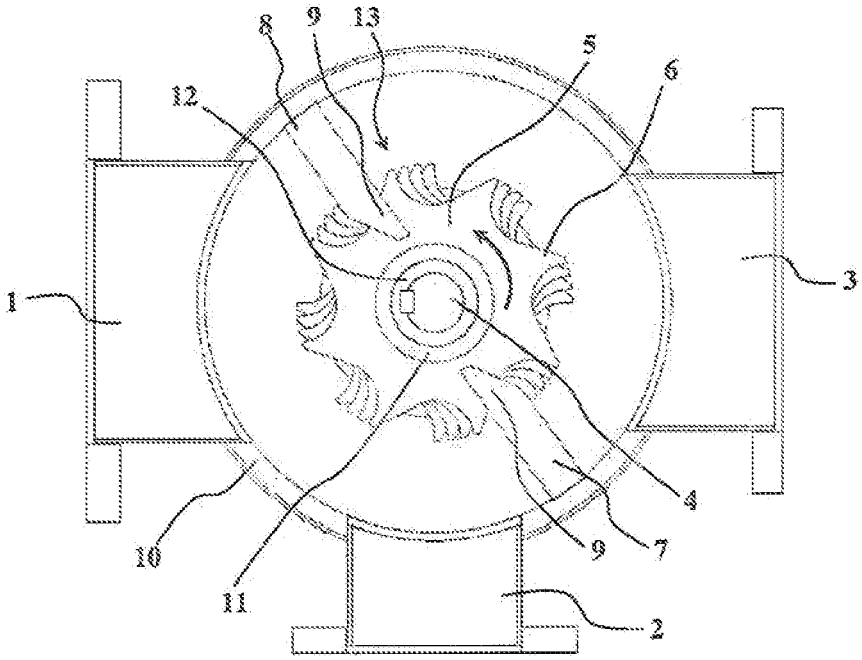
Figure 3:
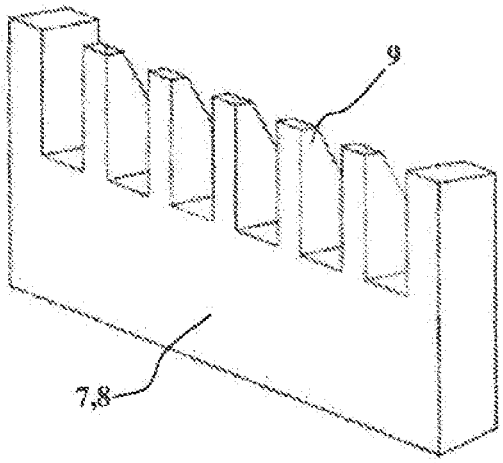
Figure 4:
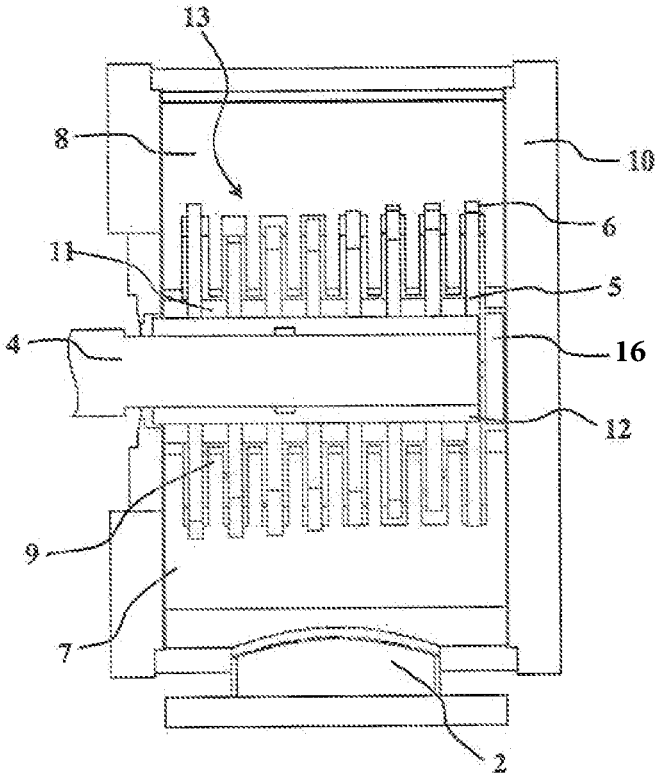
Figure 5:
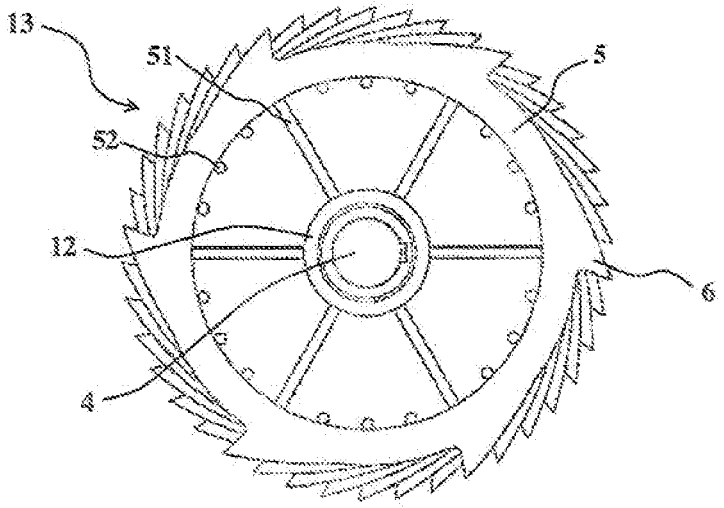
Figure 6:
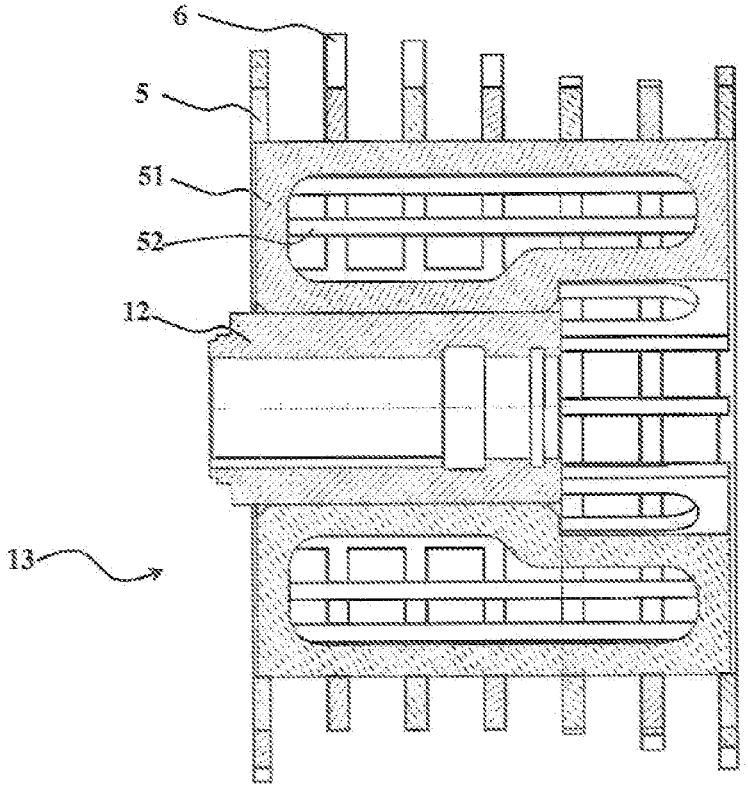
Figure 7:
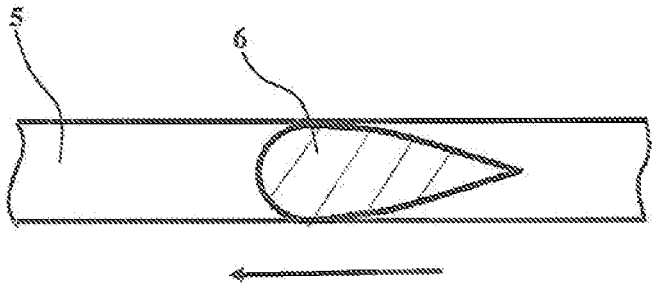
Figure 8:
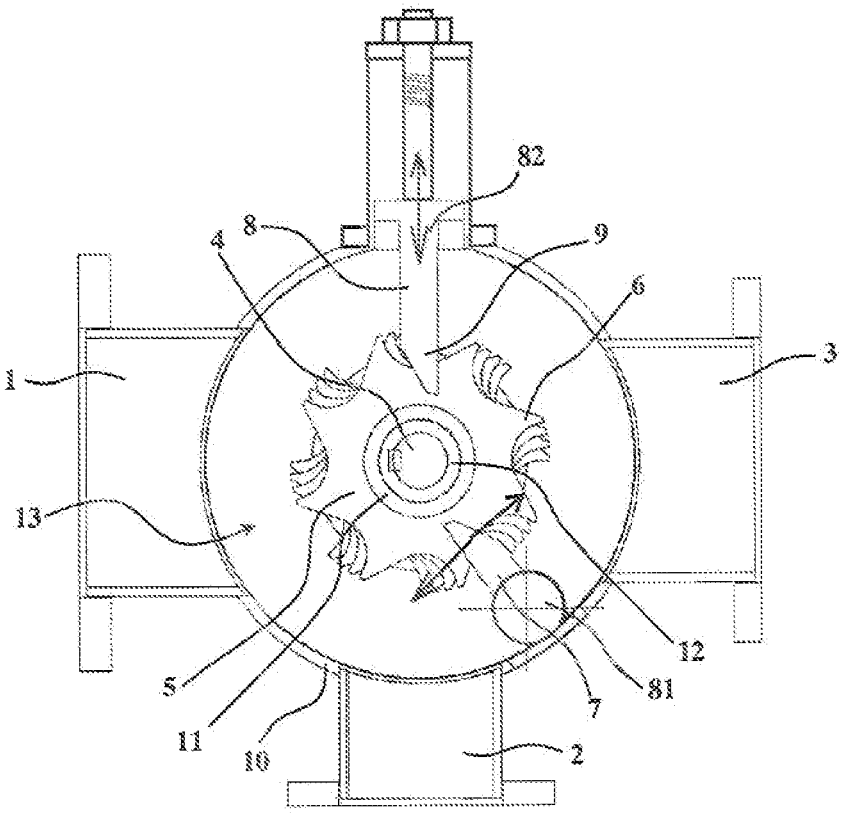
Figure 9:
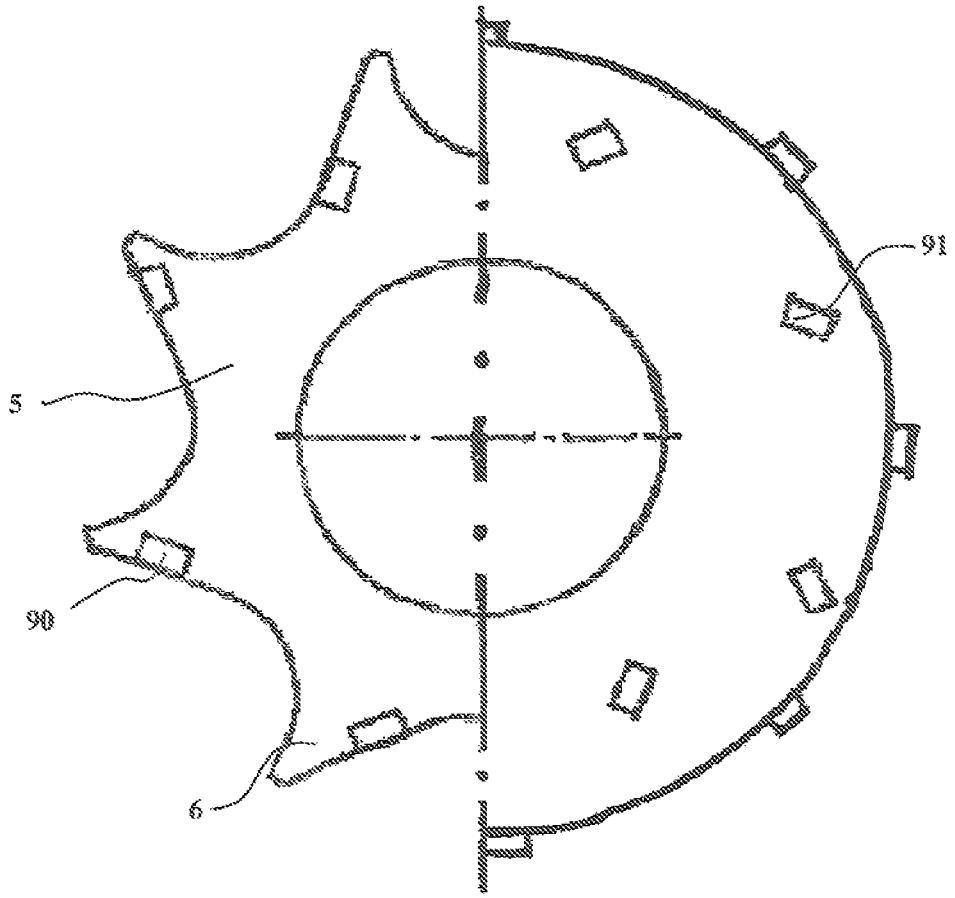

FIG. 1 illustrates a preferred embodiment, where the second sieve is close to the accept conduit, FIG. 2 illustrates another preferred embodiment of the location of the second sieve, FIG. 3 illustrates a preferred embodiment of a sieve, FIG. 4 illustrates a preferred embodiment of the separation unit from the direction of the feed conduit, FIG. 5 illustrates a preferred embodiment, where the discs are attached to each other with support members parallel to the shaft, FIG. 6 illustrates a preferred embodiment of the rotor unit in cross section, where the discs are attached to each other with support members parallel to the shaft, FIG. 7 illustrates a preferred embodiment, where the front surface of the protrusion of the disc is rounded and the back surface is tapered, FIG. 8 illustrates a preferred embodiment, where the sieves are arranged movable, and FIG. 9 illustrates preferred embodiments of the protrusions, humps and notches.

DETAILED DESCRIPTION OF THE INVENTION

FIG. 1 illustrates a preferred embodiment of the separation device having a housing 10 with a feed conduit 1 and a reject conduit 2, between which conduits 1 and 2 and an accept conduit 3 a rotor unit 13 is arranged. The rotor unit 13 has a shaft 4 transverse with respect to the through-flow direction, which shaft 4 rotates discs 5 attached to the shaft 4, and at least two sieves 7 and 8. The feed conduit 1 and accept conduit 3 are aligned such that a straight line 18 perpendicular to a rotational axis of the shaft 4 extends through the feed and accept conduits. The shaft 4 is advantageously in horizontal position. The outer surface of the discs 5 is provided with protrusions 6. Between the discs 5 there may be support sleeves 11, which keep their distances equal. More advantageous direction of rotation is marked in the Figure. The rotational speed of the discs 5 is advantageously between 200-1000 rpm. Advantageously at least some protrusions 6 of different discs 5 are at various locations in the rotational direction of the shaft 4. Advantageously the shaft is provided with a tube shaft 12, onto which the discs 5 and optional support sleeves 11 are arranged as a rotor unit 13. It is advantageous to make the discs 5 identical, but they can have a different number of various protrusions 6.

The teeth 9 of two sieves 7, 8 attached to the housing extend between the discs 5, of which sieves the first sieve 7 is between the reject conduit 2 and accept conduit 3. The second sieve 8 is between the feed conduit 1 and the accept conduit 3. The second sieve 8 is located adjacent to the accept conduit 3. Reject pieces cannot pass through the obstacles formed by the sieves 7, 8, the discs 5, the protrusions 6 and the shaft 4 or the support rings 11, but they are passed due to gravity and the impact the protrusions 6 into the reject conduit 3, via which the reject pieces are removed e.g. by means of a rotary feeder.

Advantageously one or more sensors 14 are attached to the reject conduit 3, the rotary feeder connected to the separation device or a corresponding device, to the sieves or in the vicinity of the sieves for indicating blockages and/or the filling of reject channels. The sensors 14 are connected to the control of the separation device or to process control. Sensors based on magnetism allow detecting a ferromagnetic metal piece. Ultrasound allows detecting solid pieces. Acoustic emission and/or acceleration sensors allow detecting deviations in sounds generated by the device, as well as collision of flowing pieces to structures of the device, and vibrations of the device. Pressure measurements allow detecting blockages in the separation device.

Pieces in the pulp flow that are at a density close to that of the pulp, and especially fibrous pieces, float better in the flow and they can advantageously remain to be torn, crushed and/or ground mostly at the slots between the protrusions 6 and the first sieve 7. The smaller the angle $\alpha$ between the front surface of the sieve 7, 8 and the front surface of the protrusion 6 or the substantially round outer surface, the more likely the degrading takes place. The bigger the angle $\alpha$ is, the better reject pieces are guided out of the separation unit. The angle $\alpha$ can be of different size in different sieves 7, 8. Also the dimensions of the separating slots may be optimized in different sieves 7, 8 to be of different size. The sieves 7, 8 can be in different orientations and at different locations than in the presented drawings.

FIG. 2 illustrates a corresponding separation device as FIG. 1, but its second sieve 8 is located near the feed conduit 1, whereby it guides the separated pieces better into the reject conduit 2. This sieve 8 can also be placed at the same location as a doubled second sieve 8, together with the second sieve 8 of FIG. 1.

FIG. 3 illustrates a preferred embodiment of the sieve 7, 8. Tips of the teeth 9, which extend between the discs 5 of the sieve 7, 8 are advantageously made in the thickness direction thinner than the base of the sieve 7, 8.

FIG. 4 illustrates the solution according to FIG. 1 seen from the direction of the feed conduit 1. The shaft 4 is supported on bearings to the housing 8 at the end of the motor that rotates the shaft. The end of the shaft 4 is preferably provided with a filler piece 16 between the ends of the sieves 7, 8, which filler piece forms the separating slots between the end of the shaft 4 and the sieve 7, 8. The shaft 4 can also be bearing-mounted to the housing 8 at its one end. The filler piece 16 can also act as bearing housing for the shaft 4.

FIGS. 5 and 6 illustrate a preferred embodiment, where the discs 5 are attached to the shaft 4 and to each other with support members 51, 52 parallel to the shaft 4. Because an open space is formed in the center of the rotor unit 13, acceptable pulp can pass also through the center part of the rotor unit 13. Planar support members 51 transmit the rotational force of the shaft 4 and support the discs 5. Rod-like support members 52 mainly act as sieves, if the distances between the planar support members 51 are too big. The mutual distances of the support members 51, 52 are preferably substantially of equal size as the separating slots of the rest of the structure. The shaft 4 can have a length equal to that of the rotor unit 13 or it can be shorter, whereby the center of the separation section is completely or partially open. The shaft 4 can also be divided so that the drive shaft 4 extends only to the outermost disc 5 and the other end of the rotor unit 13 is supported by a bearing-mounted support shaft to the housing 10 or to the filler piece 16.

The rotor unit 13 allowing through-passing flow can be designed so that the discs 5 are either closed or open at their center. If the rod-like support members 52 extend through the perforations of the discs or are adequately supporting and fixed to the discs, planar support members 51 are not needed. At least the outermost discs 5 have to be attached at their center opening either to the shaft 4 or to the support shaft of the other end, in order to make the rotor unit 13 robust enough without planar support members 51. Support sleeves can be provided on the rod-like support members 52 between the discs 6, which support sleeves determine the distance between the disc, if the rod-like support members 52 are not otherwise fixed to the discs.

FIG. 7 illustrates a preferred cross section of the protrusion 6 of the disc 5. The front surface of the protrusion is convex and the trailing edge is tapered for decreasing the flow resistance. The tooth of the sieve 7, 8 can be shaped in a corresponding way. A tapered trailing edge does not intensively draw and collect behind itself fibers and pieces, which might accumulate a blockage.

FIG. 8 illustrates some solutions, where the sieves 7, 8 are arranged movable. The movement possibility allows e.g. removing blockages. The first sieve 7 is hinged, whereby it can be rotated by means of an actuator most preferably counter currently, whereby a reject piece is pushed into the reject conduit 2. If the shaft of the joint 81 is e.g. spring-loaded, the sieve 7 can occasionally yield co-currently, when it is subjected to an excess force. A sensor or a switch connected to the sieve 7 or its hinge can indicate data on a coincident or an excess force to the control of the separation device or to process control or an operator. The second sieve 8 can be moved by means of an actuator of the slide 82 closer to or further from the discs 5. One or more of the sieves 7, 8 can be differently movable and located at various points of the housing 10. If there are more than two sieves 7, 8, moving at least one of the doubled sieves 7, 8 aside when needed is an especially advantageous possibility.

FIG. 9 illustrates on the left-hand side protrusions 6 on the outer surface of the disc, the protrusions having a gentle sloping front surface and a sharper trailing edge. Most advantageously the protrusions 6 have in the radial direction a height of 10-50 mm. Smaller notches or humps 90 are shaped or attached to the disc 5 or its protrusions 6. Their function is to assist in tearing, crushing and/or grinding pieces against the sieves 7, 8. A hump 90 can extend to the side of the protrusion. It can be fixed upon the front surface of the protrusion 6. Advantageously, said humps 90 or notches are located at various distances from the center of the disc 5.

The right-hand side illustrates an embodiment where the protrusions on the outer surface and the sides of the disc are humps 91 and/or notches at corresponding locations. Then the disc 5 is substantially circular. When the notches or humps 91 are of adequate size, they can act almost as the presented bigger protrusions 6. Instead of or in addition to protrusions 6, humps or notches 6, 91, the outer and side surfaces of the disc 5 can have knurling, grooving or roughening. Embodiments presented in this patent application can be used in connection with each other, though they have not been separately mentioned.

The invention claimed is:

1. A separation device for separating oversized pieces from a liquid and solids containing suspension, the separation device comprising:

a housing with a feed conduit, a reject conduit, and an accept conduit;

a rotor unit in the housing, wherein the rotor unit includes a shaft transverse with respect to a through-flow direction of the liquid and solids containing suspension flowing through the separation unit, wherein the shaft rotates discs attached to the shaft, and an outer surface and/or side surface of each of the discs has protrusions, humps and/or notches, and the teeth of at least two sieves attached to the housing extend between the discs, wherein the at least two sieves include a first sieve between the reject conduit and the accept conduit, and a second sieve between the feed conduit and the accept conduit;

wherein the feed conduit and the accept conduit are aligned such that a straight line perpendicular to a rotational axis of the shaft extends through the feed and accept conduits.

2. The separation device according to claim 1, wherein the outer surfaces of each of the discs have the protrusions, and each of the protrusions have a front surface with a slope less than a slope of a trailing edge of the protrusion.

3. The separation device according to claim 1, wherein the discs are attached to the shaft and/or to each other by planar support members and/or rod support members parallel to the shaft.

4. The separation device according to claim 1, further comprising separating slots between the rotor unit and the first and second sieves, and widths of each of the separating slots are within twenty percent of the widths of the other separating slots.

5. The separation device according to claim 1, wherein a distance between the teeth of the first sieve differs from a distance between the teeth of the second sieve.

6. The separation device according to claim 1, wherein at least one of the first and second sieves is attached to the housing by a hinge or a slide.

7. The separation device according to claim 5, wherein the attachment to the housing of at least one of the first and second sieves is movable in response to an impact of a reject piece.

8. The separation device according to claim 1, wherein the second sieve is closer to the accept conduit than to the feed conduit.

9. The separation device according to claim 1, wherein the second sieve is closer to the feed conduit than to the rejects conduit.

10. The separation device according to claim 1, wherein a front surface of at least some of the protrusions of at least some of the discs has a convex shape.

11. The separation device according to claim 1, wherein a distance from a center of the shaft to a first of the humps of the discs differs from a distance from the center of the shaft to another of the humps.

12. The separation device according to claim 1, wherein at least some of the teeth of the sieves taper towards an apex and/or a front surface of the respective one of the teeth.

13. The separation device according to claim 1, wherein at least some of the protrusions on the discs of the rotor unit are oriented in a rotational direction.

14. The separation device according to claim 1, further comprising at least one sensor configured to sense magnetism, ultrasound, acceleration, acoustic emissions and/or pressure measurements and the at least one sensor is attached to at least one of the reject conduit, to the sieves and/or to the housing.

15. A separation device comprising:

a housing defining an inner chamber and a feed conduit, a reject conduit and an accept conduit each defining a passage to the inner chamber;

discs in the inner chamber and mounted to a shaft, wherein the discs are configured to be rotated by the shaft about an axis transverse to a flow direction of a liquid and solids suspension which enters the feed conduit, flows through the inner chamber and exits the accept conduit;

the discs each have protrusions extending radially outward;

a first sieve attached to the housing and extending into the inner chamber, wherein teeth on the first sieve interlace with the protrusions of the discs, wherein the first sieve is positioned such that as the protrusions pass through the teeth of the first sieve as the discs rotate away from the accept conduit and towards the feed conduit; and a second sieve attached to the housing and extending into the inner chamber, wherein teeth on the second sieve interlace with the protrusions of the discs, wherein the second sieve is positioned such that as the protrusions pass through the teeth of the second sieve as the discs rotate away from the reject conduit and towards the accept conduit, wherein the feed conduit and the accept conduit are aligned such that a straight line perpendicular to a rotational axis of the shaft extends through the feed and accept conduits.

16. The separation device according to claim 15, wherein the protrusions have a trailing surface sloped at a greater angle than a slope of a front surface of the protrusions.

17. The separation device according to claim 15, a distance between the teeth of the first sieve differs from a distance between the teeth of the second sieve.

18. The separation device according to claim 15, at least one of the first and second sieves is attached to the housing by a hinge or a slide.

19. The separation device according to claim 15, wherein the protrusions have outer surfaces that are jagged.

20. The separation device according to claim 15, wherein the protrusions on each disc are arranged in an annular array around the disc.

21. The separation device according to claim 15, wherein the protrusions on one of the discs is offset from the protrusions on another of the discs along a direction parallel to the axis.

22. The separation device according to claim 15, wherein the protrusions include at least one of humps and notches.

* * * * *